US006354664B1

(12) United States Patent
Chen

(10) Patent No.: US 6,354,664 B1
(45) Date of Patent: Mar. 12, 2002

(54) HEIGHT ADJUSTING DEVICE FOR A CHAIR

(76) Inventor: Su-Ming Chen, No. 566, Fong-Lin 2nd Rd., Ta-Liao, Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/724,476

(22) Filed: Nov. 28, 2000

(51) Int. Cl.[7] ..... A47C 1/024; B60N 2/16
(52) U.S. Cl. ..... 297/353; 297/410
(58) Field of Search ..... 297/353, 383, 297/410, 411.36

(56) References Cited

U.S. PATENT DOCUMENTS 4,536,031 A * 8/1985 Latone ..... 297/353
4,573,737 A * 3/1986 Korn ..... 297/353
5,035,466 A * 7/1991 Mathews et al. ..... 297/353
5,551,754 A * 9/1996 Neumueller ..... 297/353
5,918,941 A * 7/1999 Kigel ..... 297/410

* cited by examiner

*Primary Examiner*—Anthony D. Barfield
(74) *Attorney, Agent, or Firm*—Merchant & Gould P.C.

(57) ABSTRACT

A height adjusting device includes a mounting frame adapted to be secured to a seat member of a chair and provided with a plurality of retaining holes in an upright direction. A sliding member is adapted to be secured to a backrest member of the chair, and is mounted to be slidable relative to the mounting frame in the upright direction. The sliding member includes an upper portion which defines a passageway, and a lower portion. A lever member is pivotally mounted on the lower portion at a fulcrum and about a pivotal axis transverse to the upright direction, and includes actuating and retained ends respectively at two opposite sides of the fulcrum. The lever member is disposed such that the retained end is extendable through the passageway to be retained in one of the retaining holes, when the actuating end is manually operated to turn the retained end about the pivotal axis. A biasing member is disposed to bias the retained end to extend through the passageway.

9 Claims, 4 Drawing Sheets

HEIGHT ADJUSTING DEVICE FOR A CHAIR

BACKGROUND OF THE INVENTION

1. Field of the Invention

The invention relates to a height adjusting device for a chair, in which most of the components of the device are concealed behind a backrest member of the chair.

2. Description of the Related Art

A conventional height adjusting device is mounted between a seat member and a backrest member of a chair, and includes a mounting frame which is secured on the seat member and which has an upright passage. A sliding member includes an upper end portion which is secured on the backrest member, and a lower end portion which is mounted in and which is movable relative to the upright passage and which is formed with a plurality of retained holes. The mounting frame has a pair of lug portions which are spaced apart from each other transverse to the upright passage such that a coil spring and a retaining member are mounted therebetween via a mounting shaft. The retaining member has a fulcrum portion which is mounted on the mounting shaft, and an engaging end and an actuated end which are disposed at two opposite sides of the fulcrum portion. The coil spring has two ends which abut against the mounting frame and the engaging end to urge the engaging end to engage one of the retained holes via a through hole in the mounting frame. When the height of the backrest member is to be adjusted relative to the seat member, the actuated end is depressed to turn the engaging end so as to disengage the engaging end from the retained hole and to permit sliding movement of the sliding member relative to the mounting frame.

It is noted that most of the components of the conventional height adjusting device are not concealed behind the backrest member, thereby resulting in an untidy appearance.

SUMMARY OF THE INVENTION

Therefore, the main object of the present invention is to provide a height adjusting device for a chair, in which most of the components of the device are concealed behind a backrest member of the chair to result in a tidy appearance.

Accordingly, a height adjusting device of the present invention is adapted to be mounted between a seat member and a backrest member of a chair, the backrest member extending in an upright direction. The height adjusting device includes a mounting frame, a sliding member, a lever member, and a biasing member. The mounting frame includes a proximate end portion adapted to be secured to the seat member, a distal end portion opposite to the proximate end portion in the upright direction and adapted to be disposed rearwardly of the backrest member, and an intermediate portion interposed between the proximate and distal end portions. The intermediate portion has front and rear intermediate wall surfaces opposite to each other in a first direction transverse to the upright direction. The rear intermediate wall surface includes a plurality of retaining members spacedly displaced from one another in the upright direction. The sliding member is adapted to be secured to the backrest member, and includes first front and rear major wall surfaces opposite to each other in the first transverse direction and mounted to be slidable relative to the intermediate portion of the mounting frame in the upright direction. The first front major wall surface is adapted to be spaced apart from the backrest member, and is disposed rearwardly of the rear intermediate wall surface. The first rear major wall surface includes an upper portion which defines a passageway extending in the first transverse direction to be communicated with the first front major wall surface, and a lower portion extending from the upper portion in the upright direction. The lever member is pivotally mounted on the lower portion at a fulcrum and about a pivotal axis which is transverse to both of the upright direction and the first transverse direction. The lever member includes actuating and retained ends respectively at two opposite sides of the fulcrum, and is disposed such that the retained end is extendable through the passageway to be disposed forwardly of the first front major wall surface so as to be retained by one of the retaining members, when the actuating end is manually operated to turn the retained end about the pivotal axis. The biasing member is disposed to bias the retained end to extend through the passageway so as to be retained by said one of the retaining members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
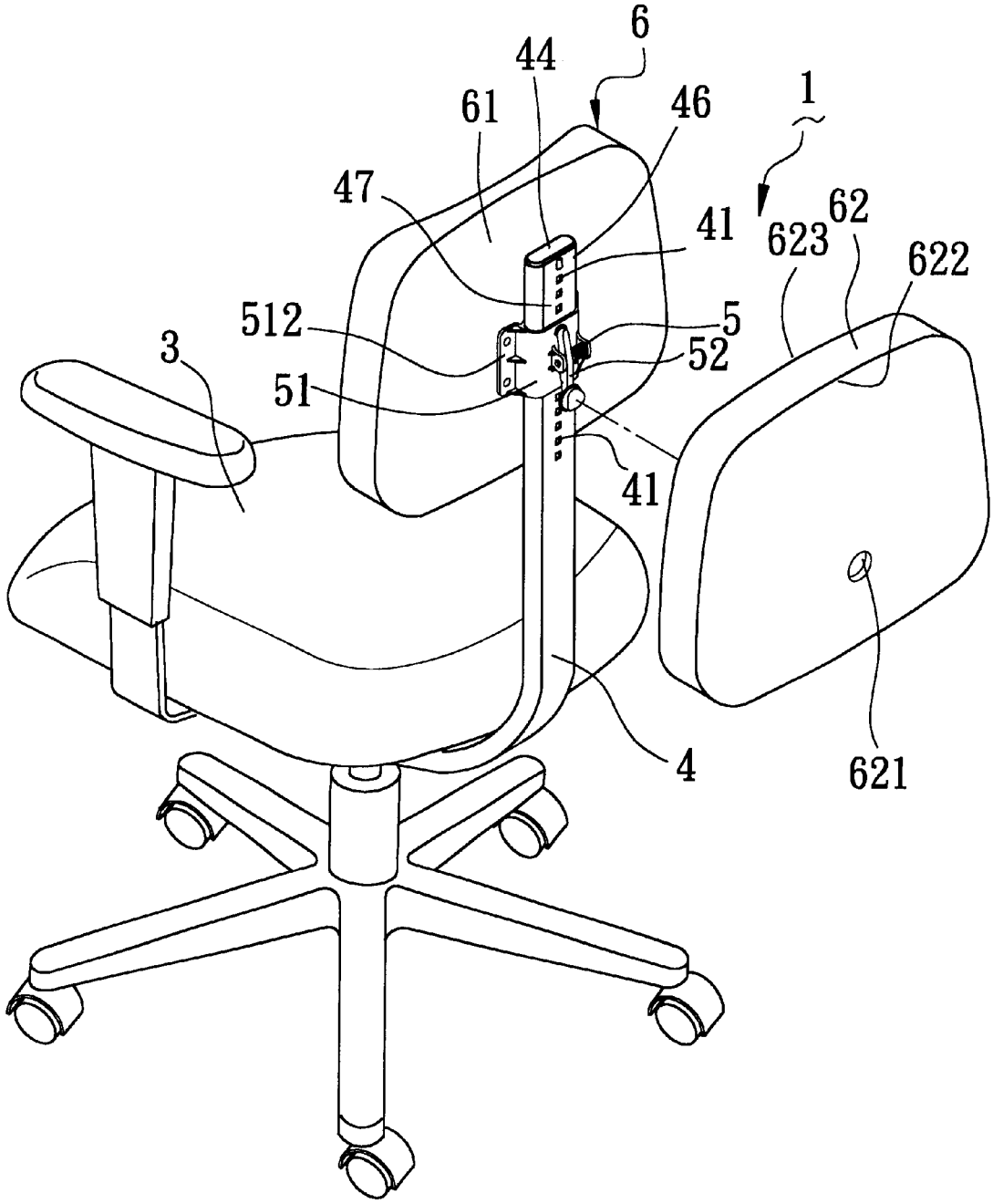
FIG. 1 is a partly exploded perspective view of a chair incorporating the preferred embodiment of a height adjusting device according to the invention.
Figure 2:
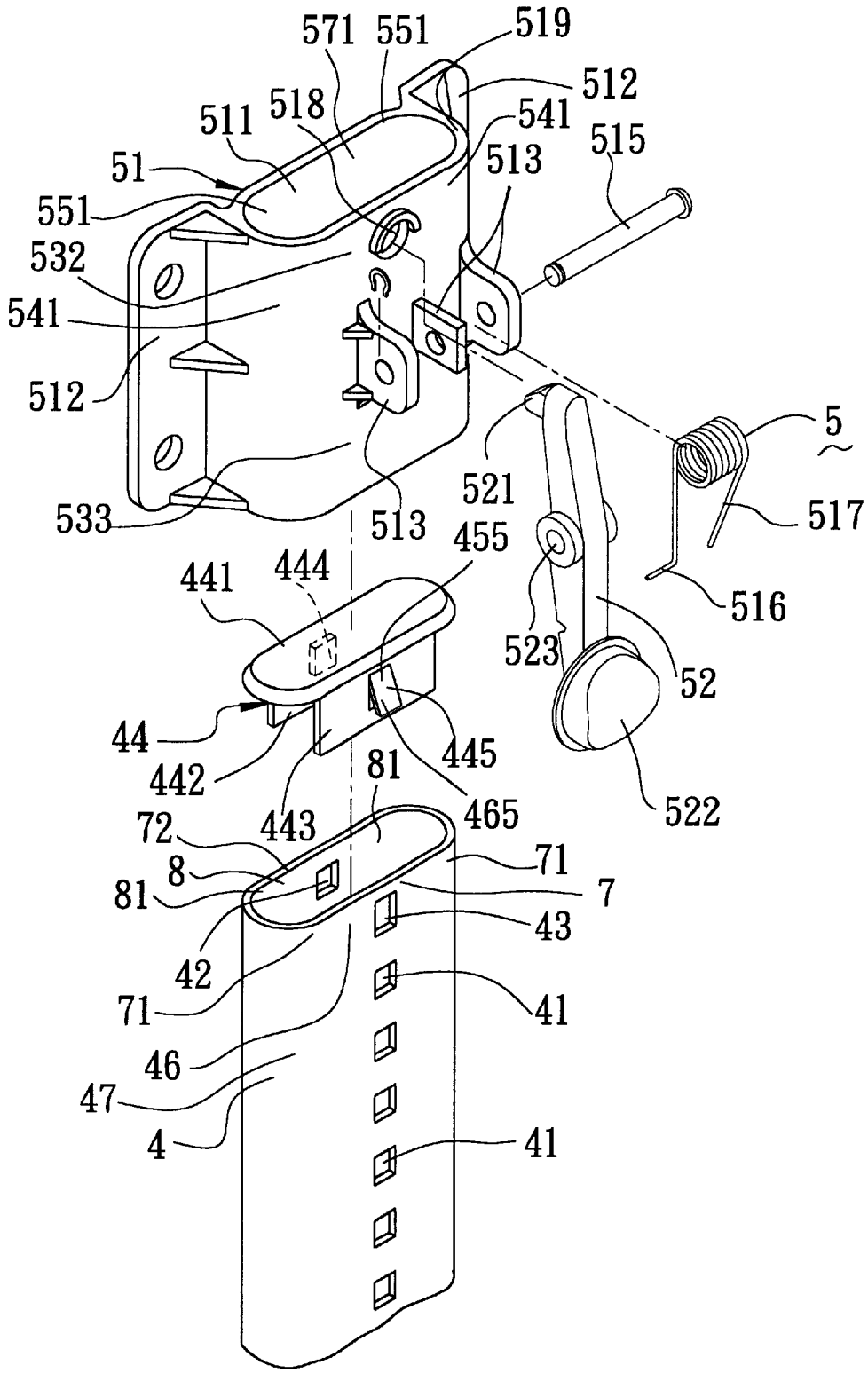
FIG. 2 is an exploded perspective view of the preferred embodiment.

Referring to FIGS. 1 and 2, the preferred embodiment of a height adjusting device according to the present invention is shown to be adapted for mounting between a seat member 3 and a backrest member 6 of a chair 1, the backrest member 6 extending in an upright direction. The height adjusting device is shown to include a mounting frame 4, a sliding member 51, a lever member 52, and a biasing member 5.

The mounting frame 4 includes a proximate end portion adapted to be secured to the seat member 3, a distal end portion 46 opposite to the proximate end portion in the upright direction and adapted to be disposed rearwardly of the backrest member 6, and an intermediate portion 47 interposed between the proximate end portion and the distal end portion 46. The distal end portion 46 includes a second rear major wall 7 that is integrally formed with the intermediate portion 47 of the mounting frame 4 and that is provided with two first lateral edges 71 opposite to each other in a longitudinal direction parallel to the pivotal axis. The intermediate portion 47 has front and rear intermediate wall surfaces 471, 472 (shown in FIG. 3) opposite to each other in a first direction transverse to the upright direction. The rear intermediate wall surface 472 includes a plurality of retaining members 41 spacedly displaced from one another in the upright direction. The retaining members 41 are in the form of a plurality of retaining holes that extend to inter-communicate the front and rear intermediate wall surfaces 471, 472.

The sliding member 51 is adapted to be secured to the backrest member 6, and includes first front and rear major wall surfaces 501, 531 (shown in FIG. 3) opposite to each other in the first transverse direction and mounted to be slidable relative to the intermediate portion 47 of the mounting frame 4 in the upright direction. The first front major wall surface 501 is adapted to be spaced apart from the backrest member 6, and is disposed rearwardly of the rear intermediate wall surface 472 of the mounting frame 4. The first rear major wall surface 531 includes an upper portion 532 which defines a passageway 518 extending in the first transverse direction to be communicated with the first front major wall surface 501, and a lower portion 533 extending from the upper portion 532 in the upright direction. Three pin mounting lugs 513 are provided on and extend from the lower portion 533.

Figure 3:
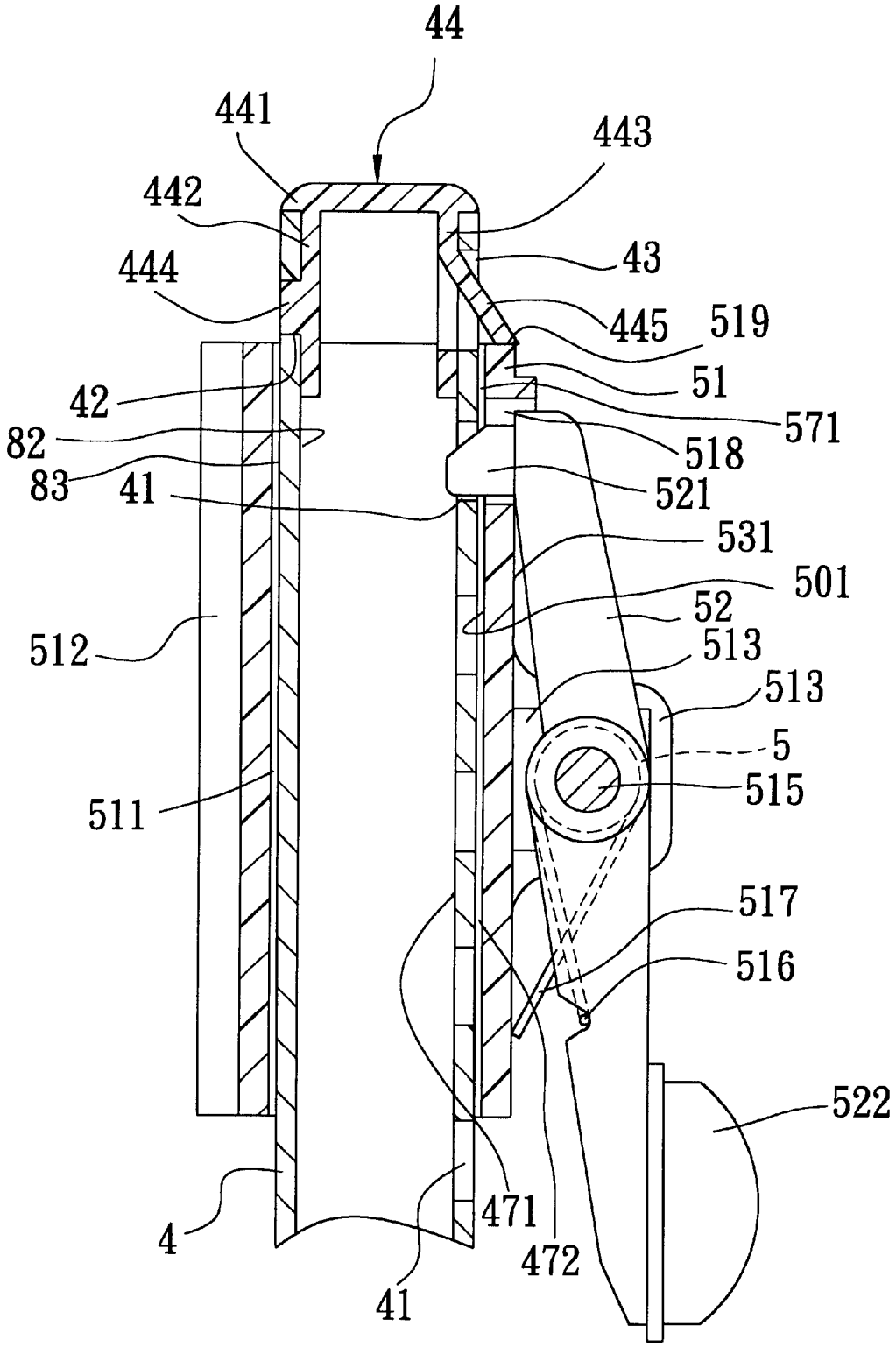
FIG. 3 is a fragmentary side sectional view of the preferred embodiment, illustrating engagement between a retained end and a retaining member.

The lever member 52 is pivotally mounted on the lower portion 533 of the sliding member 51 between left and middle ones of the three pin mounting lugs 513 by means of a pin 515 at a fulcrum 523 and about a pivotal axis which is transverse to both of the upright direction and the first transverse direction. The lever member 52 has an actuating end 522 and a retained end 521 at two opposite sides of the fulcrum 523, respectively, and is disposed such that the retained end 521 is extendable through the passageway 518 to be disposed forwardly of the first front major wall surface 501 so as to be retained by one of the retaining members 41, when the actuating end 522 is manually operated to turn the retained end 521 about the pivotal axis, as shown in FIG. 3.

The biasing member 5 is disposed to bias the retained end 521 to extend through the passageway 518 so as to be retained by one of the retaining members 41. The biasing member 5, preferably a torsion spring, is co-axially mounted with the lever member 52 between intermediate and right ones of the three pin mounting lugs 513 by means of the pin 515, and has first and second abutting ends 516, 517 that respectively abut against the actuating end 522 and the first rear major wall surface 531 of the sliding member 51.

The mounting frame 4 further includes an anchoring wall 8 which has two second lateral edges 81 opposite to each other in the longitudinal direction and respectively connected to and integrally formed with the two first lateral edges 71 of the second rear major wall 7 to space the second rear major wall 7 apart from the anchoring wall 8 in the first transverse direction so as to form an opened socket end with an upper surrounding edge 72. The anchoring wall 8 includes third front and rear wall surfaces 83, 82 opposite to each other in the first transverse direction. The third rear wall surface 82 defines a locking hole 42 which extends to communicate the third front wall surface 83 with the third rear wall surface 82.

The height adjusting device further includes a plug member 44 disposed to be inserted into the opened socket end so as to cover the latter. The plug member 44 includes a faceplate 441 extending in a first plane transverse to the upright direction, and front and rear guiding plates 442, 443 respectively disposed to extend from the faceplate 441 in the upright direction and spaced apart from each other. As such, when the plug member 44 is inserted into the opened socket end, the front and rear guiding plates 442, 443 respectively face the third rear wall surface 82 and the second rear major wall 7 of the distal end portion 46 of the mounting frame 4. The plug member 44 further includes a block member 444 disposed on the front guiding plate 442 such that when the plug member 44 is forced to be inserted into the opened socket end, the block member 444 will be urged to snap into and be engaged in the locking hole 42 by a biasing force generated once the friction force stemming from the sliding contact between the front guiding plate 442 and the third rear wall surface 82 is relieved when the block member 444 is brought to slip into the locking hole 42.

The sliding member 51 further includes an upper edge wall surface 519 extending in a second plane transverse to the upright direction and joining the upper portion 532 of the first rear major wall surface 531 and the first front major wall surface 501. The plug member 44 further includes a resilient tongue 445 which has an upper end 455 disposed on the rear guiding plate 443 and a lower end 465 extending from the upper end 455 downwards and outwards so as to protrude rearwardly of an engaging hole 43 in the second rear major wall 7, thereby abutting against the upper edge wall surface 519 to prevent further downward movement of the sliding member 51 relative to the mounting frame 4.

The first rear major wall surface 531 includes two third lateral edges 541 opposite to each other in the longitudinal direction. The sliding member 51 further includes a pair of lug portions 512 respectively extending forwardly and outwardly from the two third lateral edges 541 so as to be adapted to abut against and secured to the backrest member 6.

The sliding member 51 further includes a spacer wall 511 with two fourth lateral edges 551 opposite to each other in the longitudinal direction and respectively and integrally connected to the two lug portions 512 and disposed to be spaced apart from the first front major wall surface 501 so as to confine an accommodating passageway 571 to surround and sleeve on the mounting frame 4.

The faceplate 441 is of such a dimension as to admit insertion of the mounting frame 4 into the accommodating passageway 571 in the upright direction via downward movement of the sliding member 51 relative to the mounting frame 4.

The chair 1 further includes a back cover 62 of a dimension adapted to mate with the backrest member 6 so as to cooperate with the backrest member 6 to sandwich and conceal an assembled combination of the mounting frame 4 and the sliding member 51. The back cover 62 includes fifth front and rear major wall surfaces 623, 622 opposite to each other in the first transverse direction. The fifth front major wall surface 623 is disposed to face the first rear major wall surface 531. The fifth rear major wall surface 622 defines a through hole 621 disposed to extend to communicate with the fifth front major wall surface 623 so as to provide access to manually operate the actuating end 522 externally.

Figure 4:
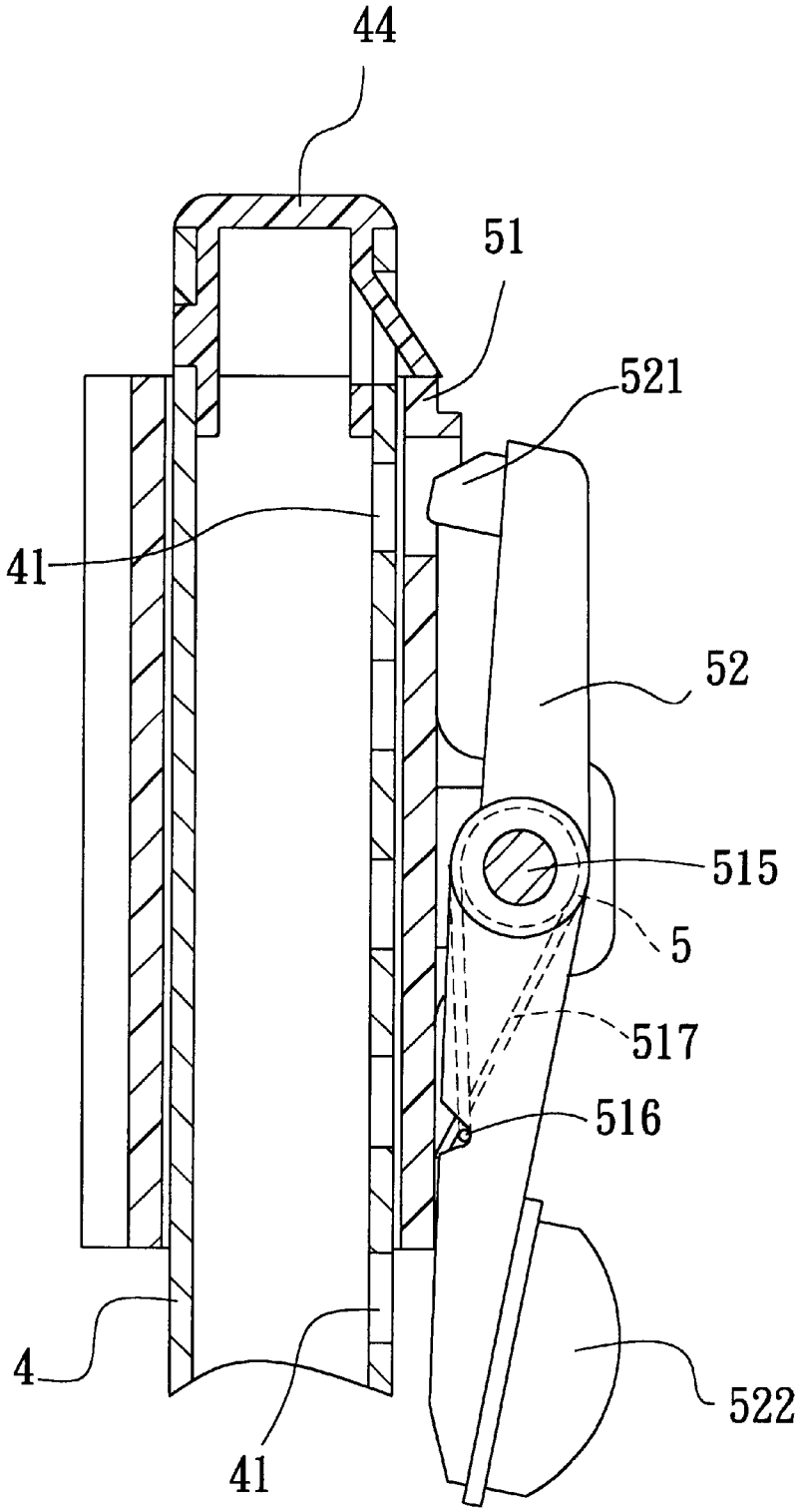
FIG. 4 is a fragmentary side sectional view of the preferred embodiment, illustrating disengagement of the retained end from the retaining member.

With reference to FIGS. 3 and 4, to conduct adjustment of the height of the backrest member 6 relative to the seat member 3, the actuating end 522 of the lever member 52 is operated so that the retained end 521 engages an appropriate one of the retaining members 41. To alter the height of the backrest member 6, the actuating end 522 is depressed to disengage the retained end 521 from one of the retaining members 41 and to permit the sliding member 51 together with the lever member 52 to slide along the mounting frame 4 to a desired position. The actuating end 522 is then released to cause the retained end 521 to engage an appropriate one of the retaining members 41. It can thus be appreciated that the present invention provides a simple and convenient way of height adjustment. Besides, the assembly of the mounting frame 4 and the sliding member 51 is essentially concealed between the backrest member 6 and the back cover 61 to result in a tidy appearance.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A height adjusting device adapted to be mounted between a seat member and a backrest member of a chair, said backrest member extending in an upright direction, said height adjusting device comprising:

a mounting frame including a proximate end portion adapted to be secured to the seat member, a distal end portion opposite to said proximate end portion in the upright direction and adapted to be disposed rearwardly of the backrest member, and an intermediate portion interposed between said proximate and distal end portions, said intermediate portion having front and rear intermediate wall surfaces opposite to each other in a first direction transverse to the upright direction, said rear intermediate wall surface including a plurality of retaining members spacedly displaced from one another in the upright direction;

a sliding member adapted to be secured to the backrest member and including first front and rear major wall surfaces opposite to each other in the first transverse direction and mounted to be slidable relative to said intermediate portion of said mounting frame in the upright direction, said first front major wall surface being adapted to be spaced apart from the backrest member and disposed rearwardly of said rear intermediate wall surface, said first rear major wall surface including an upper portion which defines a passageway extending in the first transverse direction to be communicated with said first front major wall surface, and a lower portion extending from said upper portion in the upright direction;

a lever member pivotally mounted on said lower portion of said first rear major wall surface of said sliding member at a fulcrum and about a pivotal axis which is transverse to both of the upright direction and the first transverse direction, said lever member including actuating and retained ends respectively at the opposite sides of said fulcrum and disposed such that said retained end is extendable through said passageway to be disposed forwardly of said first front major wall surface so as to be retained by one of said retaining members, when said actuating end is manually operated to turn said retained end about said pivotal axis; and a biasing member disposed to bias said retained end of said lever member to extend through said passageway so as to be retained by said one of said retaining members.

2. A height adjusting device according to claim 1, wherein said plurality of retaining members are formed as a plurality of retaining holes which respectively extend to intercommunicate said front and rear intermediate wall surfaces.

3. A height adjusting device according to claim 2, wherein said distal end portion includes a second rear major wall integrally formed with said intermediate portion, and provided with two first lateral edges opposite to each other in a longitudinal direction parallel to the pivotal axis, and wherein said mounting frame further includes an anchoring wall which has two second lateral edges opposite to each other in the longitudinal direction, and respectively connected to and integrally formed with said two first lateral edges to space said second rear major wall apart from said anchoring wall in the first transverse direction so as to form an opened socket end with an upper surrounding edge, said height adjusting device further comprising a plug member disposed to be inserted into said opened socket end.

4. A height adjusting device according to claim 3, wherein said anchoring wall includes third front and rear wall surfaces opposite to each other in the first transverse direction, said third rear wall surface defining a locking hole which extends to communicate said third front wall surface with said third rear wall surface, and wherein said plug member includes a faceplate extending in a first plane transverse to the upright direction, and front and rear guiding plates respectively disposed to extend from said faceplate in the upright direction, and spaced apart from each other such that when said plug member is inserted into said opened socket end, said front and rear guiding plates respectively face said third rear wall surface and said second rear major wall, said plug member further including a block member disposed on said front guiding plate surface such that when said plug member is forced to be inserted into said opened socket end, said block member will be urged to snap into and be engaged in said locking hole by a biasing force generated once the friction force stemming from the sliding contact between said front guiding plate and said third rear wall surface is relieved when said block member is brought to slip into said locking hole.

5. A height adjusting device according to claim 4, wherein said sliding member further includes an upper edgewall surface extending in a second plane transverse to the upright direction and joining said upper portion of said first rear major wall surface and said first front major wall surface, and wherein said plug member further includes a resilient tongue which has an upper end disposed on said rear guiding plate and a lower end extending from said upper end downwards and outwards so as to protrude rearwardly of said second rear major wall, thereby abutting against said upper edge wall surface to prevent further downward movement of said sliding member relative to said mounting frame.

6. A height adjusting device according to claim 5, wherein said first rear major wall surface includes two third lateral edges opposite to each other in the longitudinal direction, and wherein said sliding member further includes a pair of lug portions respectively extending forwardly and outwardly from said two third lateral edges so as to be adapted to abut against and secured to the backrest member.

7. A height adjusting device according to claim 6, wherein said sliding member further includes a spacer wall with two fourth lateral edges opposite to each other in the longitudinal direction respectively and integrally connected to said two lug portions and disposed to be spaced apart from said first front major wall surface so as to confine an accommodating passageway to surround and sleeve on said mounting frame.

8. A height adjusting device according to claim 7, wherein said faceplate is of such a dimension as to admit insertion of said mounting frame into said accommodating passageway in the upright direction via downward movement of said sliding member relative to said mounting frame.

9. A height adjusting device according to claim 8, further comprising a back cover of a dimension adapted to mate with the backrest member so as to cooperate with the backrest member to sandwich and conceal an assembled combination of said mounting frame and said sliding member, said back cover including fifth front and rear major wall surfaces opposite to each other in the first transverse direction, said fifth front major wall surface being disposed to face said first rear major wall surface, said fifth rear major wall surface defining a through hole disposed to extend to communicate with said fifth front major wall surface so as to provide access to manually operate said actuating end externally.

* * * * *